US006701747B2

(12) United States Patent
Hartgrove

(10) Patent No.: US 6,701,747 B2
(45) Date of Patent: Mar. 9, 2004

(54) DECORATIVE ARTICLES WITH INTERCHANGEABLE MODULES

(75) Inventor: Ronald W. Hartgrove, Houston, TX (US)

(73) Assignee: Heart & Company, Houston, TX (US)

( * ) Notice: Subject to any disclaimer, the term of this patent is extended or adjusted under 35 U.S.C. 154(b) by 38 days.

(21) Appl. No.: 09/982,662

(22) Filed: Oct. 18, 2001

(65) Prior Publication Data

US 2003/0074919 A1 Apr. 24, 2003

(51) Int. Cl.[7] ..... A44C 17/02
(52) U.S. Cl. ..... 63/29.1; 63/15
(58) Field of Search ..... 63/15, 15.2, 15.3, 63/26, 29.1

(56) References Cited

U.S. PATENT DOCUMENTS

| | | | | | |
|---|---|---|---|---|---|
| 1,182,534 | A | * | 5/1916 | Driggott | 63/29.1 |
| 1,712,171 | A | * | 5/1929 | Rochas | 63/29.1 |
| 3,192,737 | A | | 7/1965 | Schechter et al. | 63/1 |
| 3,399,547 | A | | 9/1968 | Spielman et al. | 63/15 |
| 3,543,535 | A | * | 12/1970 | Siegel et al. | 63/29.1 |
| 3,568,467 | A | * | 3/1971 | Ellison | 63/29.1 |
| 4,374,470 | A | * | 2/1983 | Isaacson | 63/29.1 |
| 4,393,667 | A | | 7/1983 | Reinstein et al. | 63/29 |
| 4,905,482 | A | | 3/1990 | Gheblikian | 63/29.1 |
| 5,133,195 | A | | 7/1992 | Appelbaum et al. | 63/29.1 |
| 5,228,317 | A | | 7/1993 | Hendricks | 63/15.7 |
| 5,357,770 | A | | 10/1994 | Lanyi | 63/29.1 |
| 5,375,434 | A | | 12/1994 | Wertheimer et al. | 63/29.1 |
| 5,636,531 | A | | 6/1997 | Miller | 63/15.6 |
| 5,682,769 | A | | 11/1997 | Baker | 63/29.1 |
| 6,003,334 | A | | 12/1999 | Miller | 63/15.5 |
| 6,131,408 | A | | 10/2000 | Gill | 63/15.8 |
| 6,484,537 | B2 | * | 11/2002 | Takessian | 63/29.1 |
| 6,490,886 | B1 | * | 12/2002 | Steinhauer et al. | 63/15 |

OTHER PUBLICATIONS

Alter Gem Jewelry Web site, http://www.altergem.com, dated Apr. 13, 2001(10 pages).*
The Caerleon Collection from Goldman Kolber Web site, http://www.goldmankolber.com/caerleon.html, dated Apr. 9, 2001(4 pages).*
Goldman Kolber, Inc Brochure, no date provided (2 pages).*
Wilkinson Ringdant designed by A. Z. Palais 1960 Website, http://www.150.si.edu/150trav/imagine/m413.htm, dated Apr. 4, 2001 (1 page).*

* cited by examiner

*Primary Examiner*—Andrea Chop
(74) *Attorney, Agent, or Firm*—Howrey Simon Arnold & White LLP

(57) ABSTRACT

Decorative articles having interchangeable modules. The decorative articles, such as rings, include a body or shank having first and second surfaces and defining an aperture therethrough. The interchangeable modules may be mounted, either individually or in combination, on the body from the side, the outside or the inside of the body or shank. In one aspect, the interchangeable modules include first and second portions. The first portion, at least partially disposed in the aperture, retains against the first surface adjacent the aperture. The second portion is connected to the first portion and is disposed adjacent the second surface. The supporting member is pivotally attached to the first surface and is selectively pivotable to contact the first portion and maintain the module mounted on the body.

34 Claims, 13 Drawing Sheets

DECORATIVE ARTICLES WITH INTERCHANGEABLE MODULES

FIELD OF THE INVENTION

The present invention relates generally to decorative articles having interchangeable modules, and more particularly to rings having interchangeable modules that may be mounted, either individually or in combination, from the side, the inside or the outside of the rings.

BACKGROUND OF THE INVENTION

The desirability of having decorative articles, such as rings, with interchangeable settings has long been evident in the art. Interchangeable settings allow a wearer to match the decorative article with other articles of jewelry, clothing, or accessories. Several rings with interchangeable settings are disclosed in the prior art. Many of these rings use a device attached to the interchangeable setting to hold the setting on the ring. For example, U.S. Pat. Nos. 3,399,547; 4,393,667; 5,133,195; and 5,357,770 disclose a device, such as a latch, a lever, a flexible member, or an arm, that is attached to the interchangeable setting and holds the setting on the ring.

Other prior art rings disclose a device connected to the ring to hold the interchangeable setting on the ring. For example, U.S. Pat. Nos. 4,905,482; 5,228,317; and 5,375,434 disclose devices, such as a second shank, a door, a cover, or hooks, that are connected to the ring and that hold the settings in an opening in the ring.

Another device for holding interchangeable settings to a ring is disclosed in U.S. Pat. No. 6,131,408. In this patent, a collar is disposed within a blind bore in the inner surface of the ring. The interchangeable setting or enhancer includes a stem with a bulbous distal portion that is attached to the ring by inserting the stem in the blind bore and through the collar, which deforms and retains the stem.

Unfortunately, there are some disadvantages in the rings and interchangeable settings found in the prior art. For example, some prior art rings and interchangeable settings are relatively complicated and costly to manufacture. In addition, some prior art rings rely on wearable parts to hold the interchangeable settings. These wearable parts may become worn with repeated changing of the settings on the ring, negating their utility.

Importantly, some prior art devices for holding the interchangeable settings to the ring are not readily disguised or hidden. Consequently, the interchangeable settings do not appear as an integral part of the ring, which detracts from the aesthetic value of the ring. Furthermore, many rings in the prior art permit only one interchangeable setting to be attached at a time. Moreover, many rings in the prior art permit the interchangeable settings to be mounted only in a single fashion relative to the ring, e.g., mounted from outside of the ring.

The present invention is directed to overcoming, or at least reducing the effects of, one or more of the problems set forth above.

SUMMARY OF THE INVENTION

One aspect of the present invention provides a decorative article, including a body, an interchangeable module, and a supporting member. The body has first and second surfaces and defines an aperture therethrough. The interchangeable module includes means for retaining the module against the first surface adjacent the aperture. The supporting member is pivotally attached to the first surface of the body and is selectively pivotable to contact the retaining means of the module and maintain the module mounted on the body.

Another aspect of the present invention provides a decorative article, including a body, an interchangeable module, and a supporting member. The body has first and second surfaces and defines a slot therethrough. The interchangeable module includes a decorative portion, a narrow member, and a retaining member. The decorative portion is disposed adjacent the second surface of the body. The retaining portion is connected to the decorative portion and is received in the slot. The narrow member is connected to the decorative portion and is positioned in the slot. The retaining member is connected to the narrow member and engages the first surface of the body adjacent the slot. The supporting member is pivotally attached to the first surface of the body and is selectively pivotable to contact the retaining member and maintain the module mounted on the body.

Yet another aspect of the present invention provides a decorative article, including a body, an interchangeable module, and a supporting member. The body has first and second surfaces and defines a mounting hole therethrough. The module is interchangeably mounted on the body. The module includes a decorative portion and a retaining portion. The decorative portion is disposed adjacent the second surface of the body. The retaining portion is connected to the decorative portion and engages the first surface of the body adjacent the mounting hole. The supporting member is pivotally attached to the first surface of the body and is selectively pivotable to contact the retaining portion and maintain the module mounted on the body.

A still further aspect of the present invention provides a decorative article, including a body, an interchangeable module, and a supporting member. The body has first and second surfaces and defines an aperture therethrough. The interchangeable module includes a decorative portion and at least one retaining member. The decorative portion is disposed adjacent the second surface of the body. The at least one retaining member includes an arm and a catch. The arm is pivotally attached to the decorative portion and is disposed through a catch opening defined by the aperture. The catch is disposed on a distal end of the arm. The catch engages the first surface of the body adjacent the catch opening. The supporting member is pivotally attached to the first surface of the body and is selectively pivotable to contact the at least one retaining member and maintain the module mounted on the body.

Another aspect of the present invention provides a method for mounting an interchangeable module on a body. The body has first and second surfaces and defines an aperture therethrough. The method comprises the steps of: disposing a portion of the module at least partially through the aperture; retaining the portion against the inner surface adjacent the aperture; pivoting a member attached to the inner surface; contacting the portion with the member; and maintaining the portion retained against the inner surface with the member.

The foregoing summary is not intended to summarize each potential embodiment or every aspect of the invention disclosed herein, but is intended merely to summarize the appended claims.

BRIEF DESCRIPTION OF THE DRAWINGS

The foregoing summary, preferred embodiments, and other aspects of the present invention will be best understood with reference to a detailed description of specific embodiments of the invention, which follows, when read in conjunction with the accompanying drawings, in which.

Figure 1:
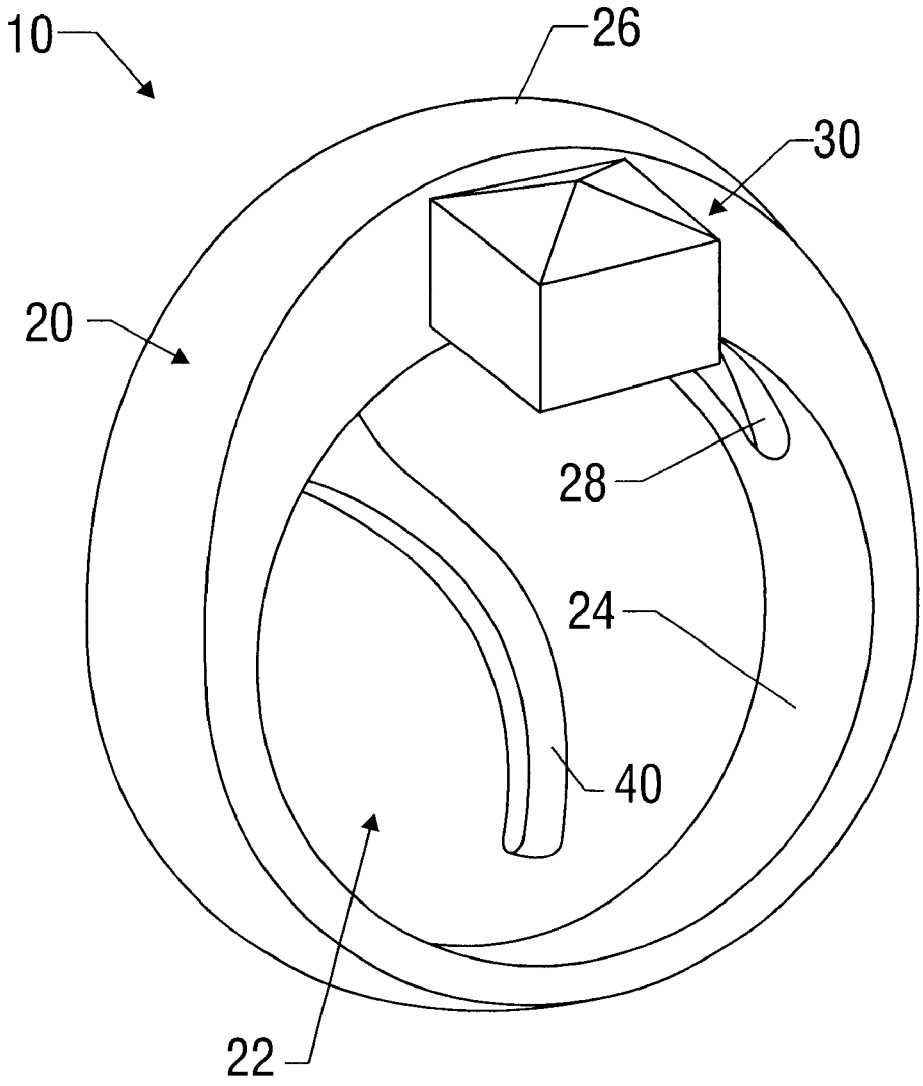
FIG. 1 illustrates a perspective view of an embodiment of a decorative article in accordance with the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the scope of the invention as defined by the appended claims.

DETAILED DESCRIPTION OF THE INVENTION

Figure 2A:
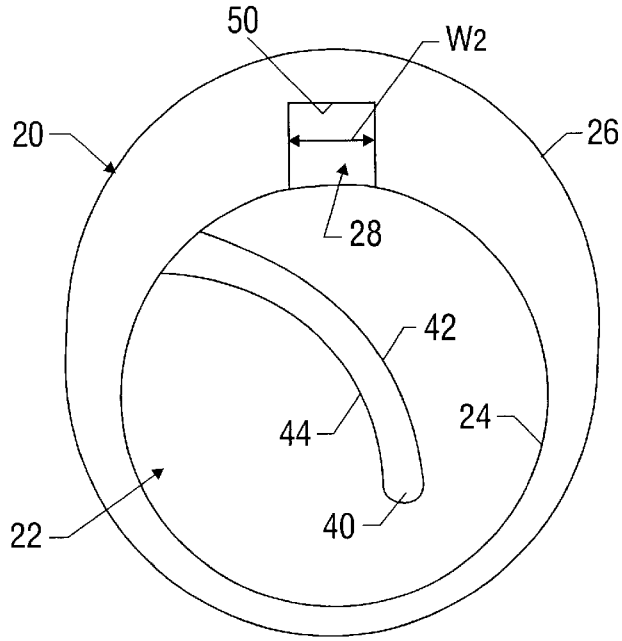
FIGS. 2A–B illustrate the embodiment of the body of FIG. 1.
Figure 2B:
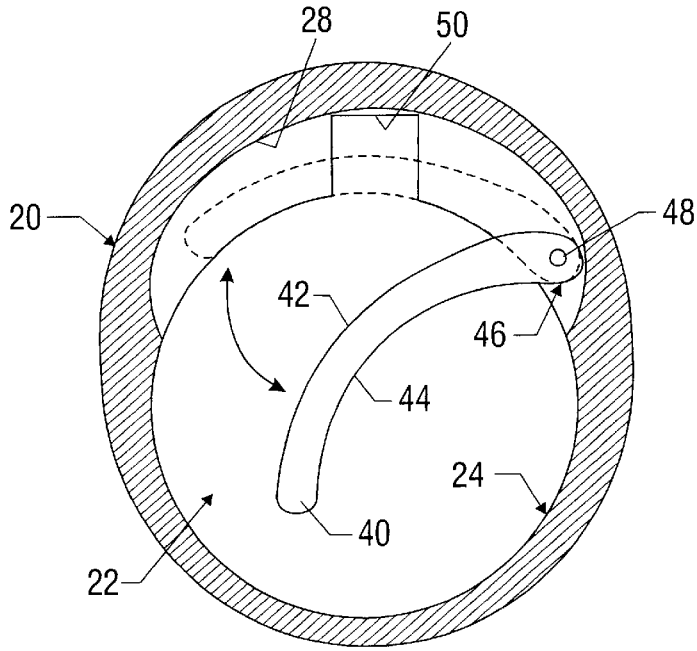
Figure 3A:
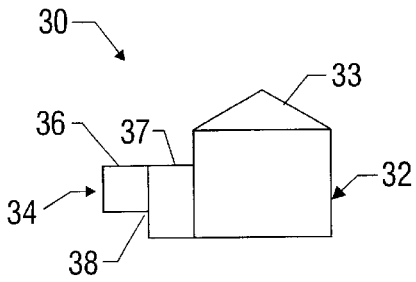
FIGS. 3A–B illustrate the embodiment of the interchangeable module of FIG. 1.
Figure 3B:
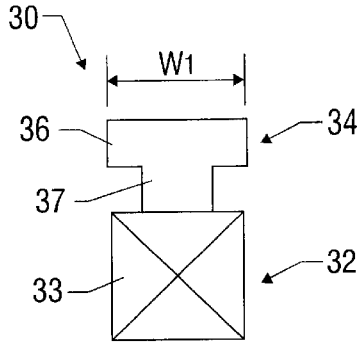

Referring to FIGS. 1–3, an embodiment of a decorative article 10 in accordance with the present invention is illustrated. FIG. 1 illustrates a perspective view of the decorative article 10 including a body or shank 20 and a module 30. FIGS. 2A–B illustrate the body 20 of FIG. 1 in a side view and a cross-sectional view, respectively. FIGS. 3A–B illustrate the interchangeable module 30 of FIG. 1 in a side view and a top view, respectively.

In the present embodiment, the decorative article 10 is a ring, where the body or shank 20 is worn on a finger. The body or shank 20 is composed of a suitable material, such as a precious metal, and may be formed by those methods known in the art, such as machining, casting, soldering, or a combination thereof. The body or shank 20, which is best depicted in FIGS. 2A and 2B, has a first, inner surface 24 and a second, outer surface 26 and defines an aperture or slot 50 therethrough. In the present embodiment of the ring, the body 20 includes an opening 22 defined by the inner surface 24. The opening 22 receives the finger of the person wearing the ring 10. The body 20 may further include an inner cavity or hollow 28 defined by the inner surface 24 and adjacent the slot 50.

The module 30 is an interchangeable, decorative piece mounted on the body or shank 20. In the present embodiment, the module 30 is mounted to the side of the body 20. The interchangeable module 30, which is best depicted in FIGS. 3A and 3B, includes a decorative portion 32 and a retaining portion 34. The decorative portion 32 includes a decorative surface or element 33, such as a finial or mounted gemstone, and disposes adjacent the outer surface 26 of the body 20. The retaining portion 34 attaches or mounts the decorative portion 32 on the body 20.

The retaining portion 34 positions in the slot 50 and engages with or retains against the inner surface 24 adjacent the slot 50. In the present embodiment, the retaining portion 34 includes a retaining member 36 connected to the decorative portion 32 by an adjoining or narrow member 37. Adjacent the opening 22, the slot 50 has an open side that receives the narrow member 37. The retaining member 36 disposes in the hollow 28 and engages with or retains against the inner surface 24 adjacent the slot 50. Thus, the retaining portion 34 positions on the body 20 from substantially one direction, e.g. from the opening 22 defined by the inner surface 24.

In general, the retaining member 36 has a dimension or width $W_1$ that is greater than a dimension or width $W_2$ defined by the slot 50. In the present embodiment, the retaining member 36 and narrow member 37 form a "tee." Other suitable structures for the retaining portion 34 may include a narrow member 37 having a bulbous end, tooth, hook, or cross member forming the retaining member 36. As best shown in the side view FIG. 3A, the narrow member 37 may have a greater depth than the retaining member 36, and a retaining shoulder 38 may be formed therebetween.

In accordance with the present invention, the decorative article 10 includes a supporting member or bar 40 pivotally attached to the inner surface 24 of the body 20. A pivotal connection 46 is formed between the supporting member 40 and the body 20 and is preferably disposed in the inner cavity or hollow 28 of the body 20. To form the pivotal connection 46, small holes (not shown) may be drilled, laser cut or cast in place in the surfaces 26 and 24 on both sides of the hollow 28. A small rod or pivot 48 may be positioned through one hole in the body, passed through a bore in the end of the supporting member 40, and then positioned in the other small hole in the body. The ends of the rod 48 may then be secured or fused in the holes. As best evidenced in FIG. 2A, the outside surface 26 is preferably smoothed and polished to hide the construction of the pivotal connection 46 and enhance the aesthetic appearance of the article 10.

The supporting member 40 is pivotable between a first, released position and a second, supporting position. In the present FIGS. 1 and 2A, the supporting member 40 is shown disposed within the opening 22 and in the second, supporting position. As shown by the dashed lines in FIG. 2B, the supporting position of the supporting member 40 corresponds to the member 40 being pivoted adjacent the inner surface 24. In the supporting position, a first, retaining surface 42 of the supporting member 40 contacts the retaining portion 34 of the module 30 and maintains the module 30 mounted in the slot 50.

In the supporting position, the supporting member 40 is preferably disposed within and hidden by the hollow 28 defined by the inner surface 24. Moreover, a second, completing surface 44 of the supporting member 40 is preferably contoured to complete the form of the opening 22 when the supporting member 40 is positioned in the hollow 28. Thus, the supporting member or bar 40 completes the body or shank 20 of the ring 10 and functions without detracting from the aesthetic appearance of the ring 10.

The supporting member or bar 40 advantageously acts in conjunction with the body of the wearer to sustain the interchangeable module 30 mounted on the body 20. However, the supporting member 40 may be sufficient, in itself, to remain in the supporting position when not in contact with the wearer and maintain the module 30 mounted on the body or shank 20. For example, the supporting member 40 may have an interference or friction fit with the inner surface 24 of the body 20 when in the supporting position. Alternatively, a locking mechanism, such as disclosed below with reference to FIGS. 17A–D, may be used to sustain the supporting member 40 in the supporting position.

Figure 4A:
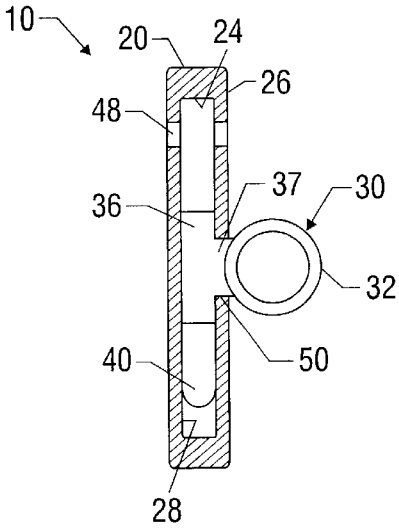
FIGS. 4A–B illustrate top views of additional embodiments of decorative articles of FIG. 1.

To further illustrate the structure and operation of the present invention, the decorative article 10 is illustrated in a top view of FIG. 4A. The body 20 in FIG. 4A is shown cut away to reveal the arrangement of the hollow 28, supporting member 40, and retaining portion 34. The interchangeable module 30 is mounted to the body 20 by positioning the adjoining or narrow member 37 in the slot 50. The retaining member 36 is disposed in the hollow 28 and adjacent the inner surface 24. The decorative portion 32, connected to the narrow member 37, is disposed adjacent the outer surface 26 of the body 20.

The retaining member 36 engages with or retains against the inner surface 24 adjacent the slot 50 and has a dimension or width greater than a dimension or width of the slot 50. In this way, the retaining member 36 prevents the retaining portion 34 from escaping through the slot 50. The module 30 is thus limited to removal from the body 20 in only the one direction from which it is inserted, e.g. the open side of the slot 50. The supporting member 40 contacts the retaining member 36 in the one direction and maintains the module 30 mounted on the body 20. By reversing the above assembly, the module 30 may be selectively removed from the body 20.

Figure 4B:
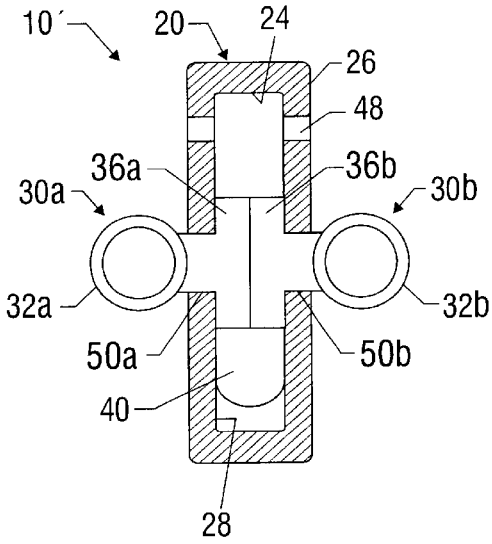

In another embodiment of the present invention, the decorative article 10' in FIG. 4B includes first and second modules 30*a* and 30*b* mounted on either side of the body 20. The body 20' in FIG. 4B is shown cut away to reveal the arrangement of the hollow 28, supporting member 40, and retaining portions 34*a* and 34*b*. The first and second modules 30*a* and 30*b* are individually disposed in first and second slots 50*a* and 50*b* so that both retaining members 36*a* and 36*b* are disposed adjacent one another within the hollow 28. The supporting member 40 contacts both of the retaining members 36*a* and 36*b* to maintain the modules 30*a* and 30*b* mounted on the body 20'. The body or shank 20' in FIG. 4B preferably has a width that is approximately twice that of the body 20 in FIG. 4A. In this way, settings may be interchangeably used with the narrower body 20 in FIG. 4A and with the wider body 20' in FIG. 4B.

Figure 5A:
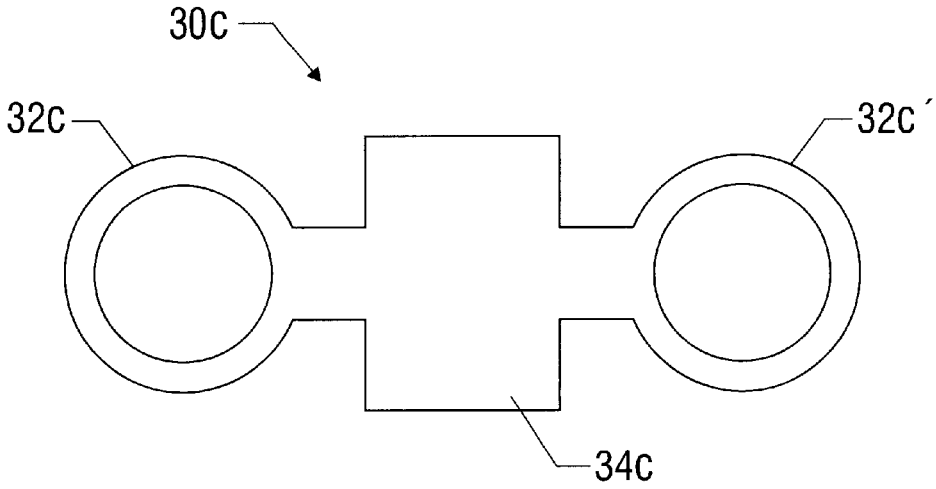
FIGS. 5A–B illustrate additional embodiments of interchangeable modules.

In an alternative embodiment, the first and second modules 30*a* and 30*b* may be integrally connected. Referring to FIG. 5A, an alternative embodiment of an interchangeable module 30*c* is illustrated. The module 30*c* includes first and second decorative portions 32*c* and 32*c'* integrally formed on either side of a common, retaining portion 34*c*. The retaining portion 34*c* positions in the hollow 28 of the body 20' having two slots 50*a* and 50*b*, such as described above in FIG. 4B.

Figure 5B:
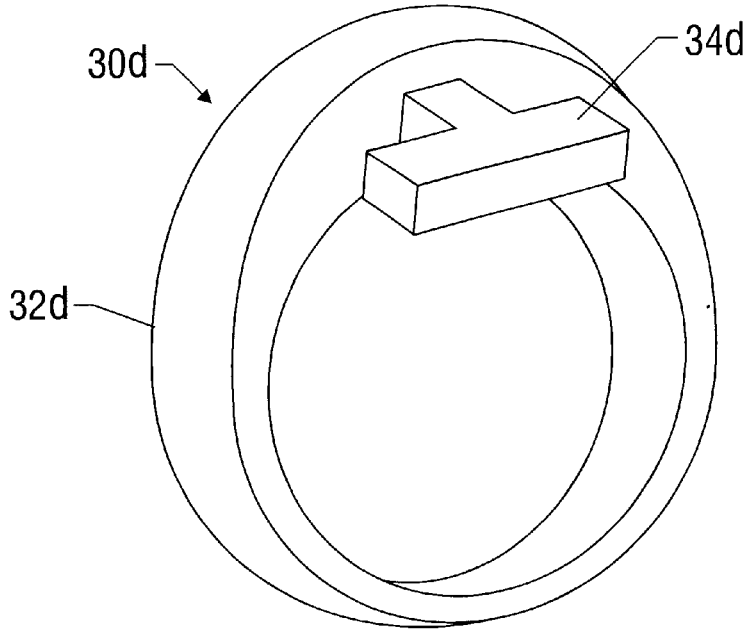

Referring to FIG. 5B, yet another embodiment of an interchangeable module 30*d* is illustrated. The interchangeable module 30*d* includes a decorative portion 32*d* and includes a retaining portion 34*d*, such as a "Tee," attached to the decorative portion 32*d*. In the present embodiment, the decorative portion 32*d* is a guard or a band that positions adjacent the body of the decorative article or ring to which the module 30*d* attaches. Either one or two of such modules 30*d* may be interchangeably mounted adjacent the body of the decorative article or ring, such as described above with reference to FIGS. 4A–B. In addition, two such decorative portions or guards 32*d* may be integrally connected by a common, retaining portion, such as described above. The module 30*d* may be particularly advantageous when used as part of a wedding ring set. Wedding ring sets having several bands or rings do not typically stay aligned on the finger of the wearer. Using the module 30*d* overcomes this shortcoming.

Figure 6:
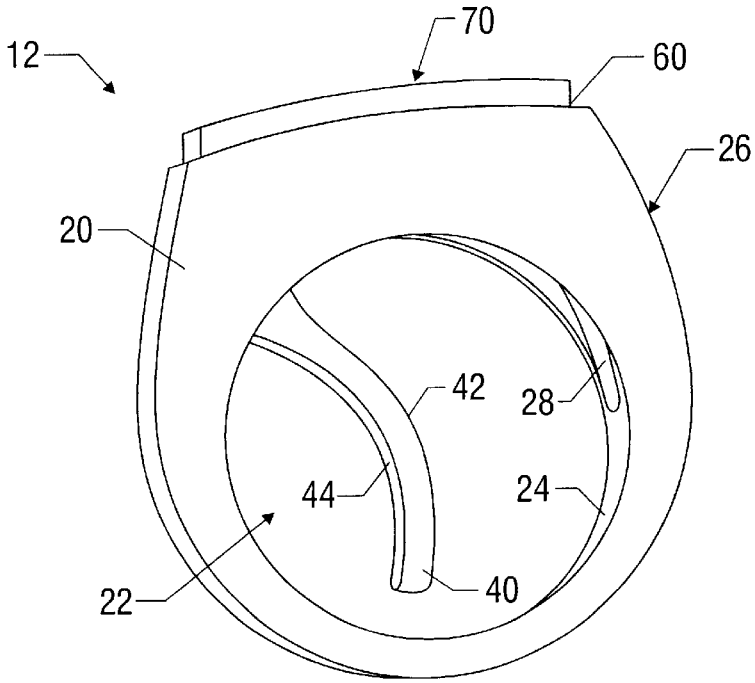
FIG. 6 illustrates another embodiment of a decorative article in accordance with the present invention.
Figure 7:
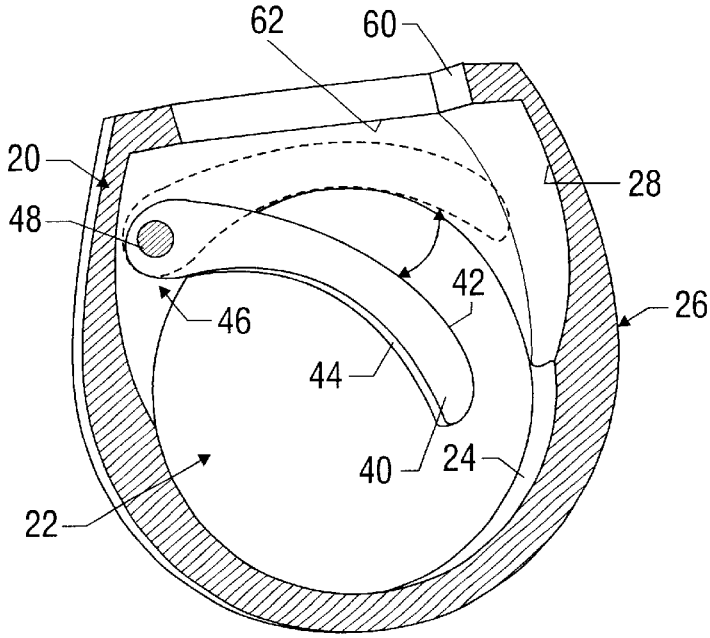
FIG. 7 illustrates a cross-sectional view of the embodiment of the body of FIG. 6.
Figure 8A:
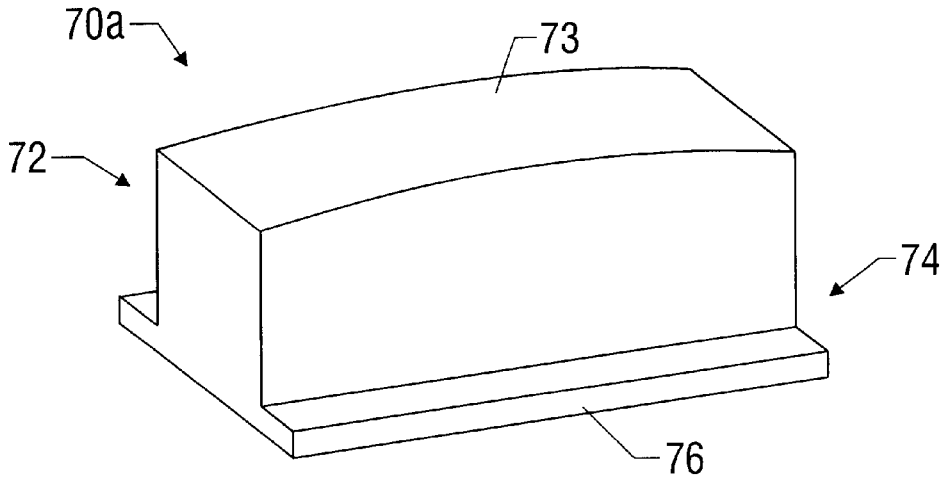
FIGS. 8A–B illustrate embodiments of interchangeable modules in accordance with the decorative article of FIG. 6.
Figure 8B:
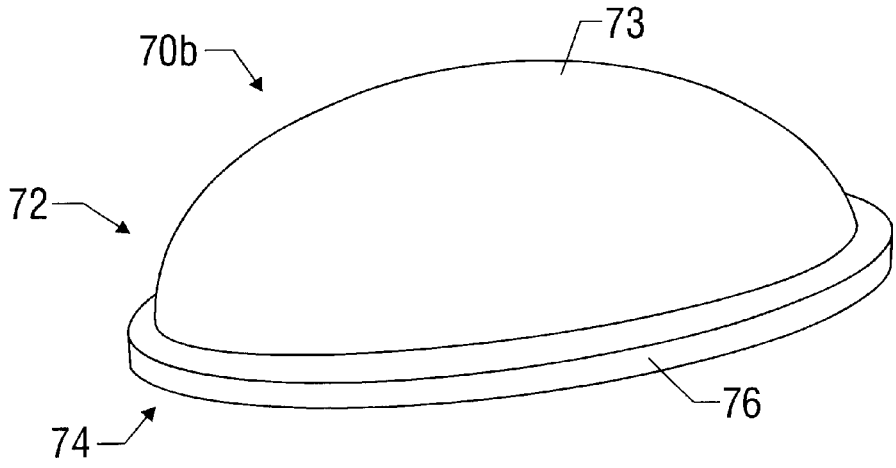

Referring to FIGS. 6–8, another embodiment of a decorative article 12 with an interchangeable module 70 in accordance with the present invention is illustrated. In FIG. 6, the decorative article 12 including a body or shank 20 and a module 70 is illustrated in a perspective view. FIG. 7 illustrates the body 20 of FIG. 6 in a cross-sectional view, and FIGS. 8A–B illustrate perspective views of embodiments of interchangeable modules 70.

As discussed above, the body 20 includes inner and outer surfaces 24 and 26 and defines an aperture or mounting hole 60 therethrough. The body 20 includes an opening 22 defined by the inner surface 24 and include an inner cavity or hollow 28 defined by the inner surface 24 adjacent the aperture or mounting hole 60. A supporting member or bar 40 is pivotally attached to the inner surface 24 by a pivotal connection 46 preferably disposed in the hollow 28.

The module 70, such as the embodiments depicted in FIGS. 8A–B, is an interchangeable decorative piece, which in the present embodiment is mounted from the inner surface 24 of the body 20 as described below. The inner-mounted module 70 includes a decorative portion 72 and a retaining portion 74. The decorative portion 72 may have a decorative element 73. The retaining portion 74 is connected to the decorative portion 72 and has an increased dimension or positive stopping surface 76.

The module 70 is mounted on the body or shank 20 by inserting the decorative portion 72 into the mounting hole 60 from the inner surface 24. The module 70 is positioned so that the decorative element 73 is visible from the outside surface 26 of the body 20. The module 70 is inserted until the retaining portion 74 engages with or retains against the inner surface 24 adjacent the mounting hole 60. More specifically, the module 70 is inserted until a decreased dimension or shoulder 62 of the mounting hole 60 stops or contacts the increased dimension or positive stopping surface 76 of the module 70.

The retaining portion 74 prevents the module 70 from passing through the mounting hole 60 towards the outer surface 26. The module 70 is thus limited to removal from the body 20 in only one direction towards the inner surface 24. The supporting member 40 is then pivoted to contact the retaining portion 74 in the one direction and hold the module 70 in the mounting hole 60. In particular, the retaining surface 42 contacts the bottom of the module 70 and the completing surface 44 completes the contour of the opening 22. The module 70 may be selectively removed from the body 20 by reversing the above assembly. The present embodiment is suitable for modules that have a decorative element 73 that has a dimension approximately equal to or less than the decreased dimension or shoulder 62 of the mounting hole 60. For example, the decorative element 73 may include pavé gems.

Referring to FIG. 8A, an embodiment of an interchangeable module 70*a* in accordance with the decorative article 12 of FIG. 6 is illustrated in a perspective view. The present embodiment of the interchangeable module 70*a* has a longitudinal shape, meaning that two, parallel sides are substantially longer than the other parallel sides. The decorative portion 72 includes the decorative surface or element 73. The retaining portion 74 includes the increased dimension or positive stopping surface 76. For the longitudinal module 70*a* of the present embodiment, it is preferable that the positive stopping surface 76 be formed only on the two longitudinal sides of the module 70*a*. This has been found to facilitate the positioning of the module 70*a* within the mounting hole 60 as discussed above.

In other embodiments, the increased dimension or positive stopping surface 76 may be formed around all sides of the retaining portion 74. One such embodiment is illustrated in FIG. 8B. In this embodiment, the module 70*b* has an oval shape. The decorative item 73 on the decorative portion 72 may be, for example, a large stone. The increased dimension or positive stopping surface 76 circumscribes the entire retaining portion 74. This arrangement is suitable for modules with shapes that are, for example, square, round, oval, rectangular, or triangular.

Figure 9A:
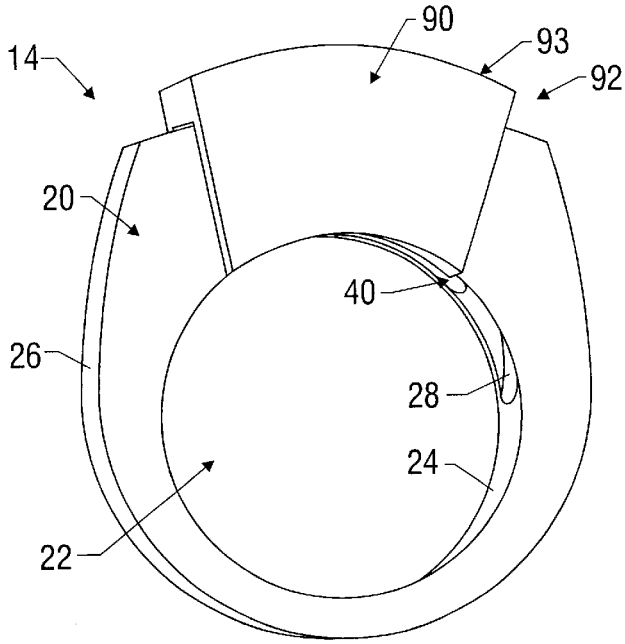
FIGS. 9A–B illustrate yet another embodiment of a decorative article in accordance with the present invention.
Figure 9B:
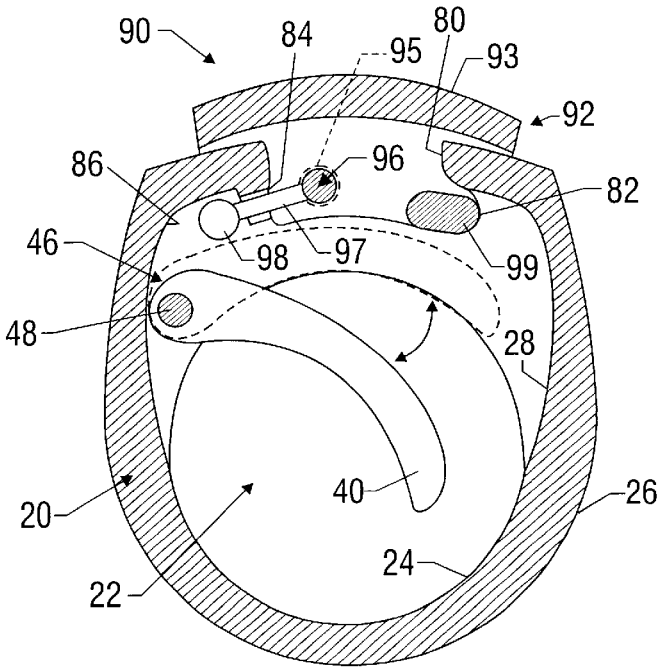
Figure 10:
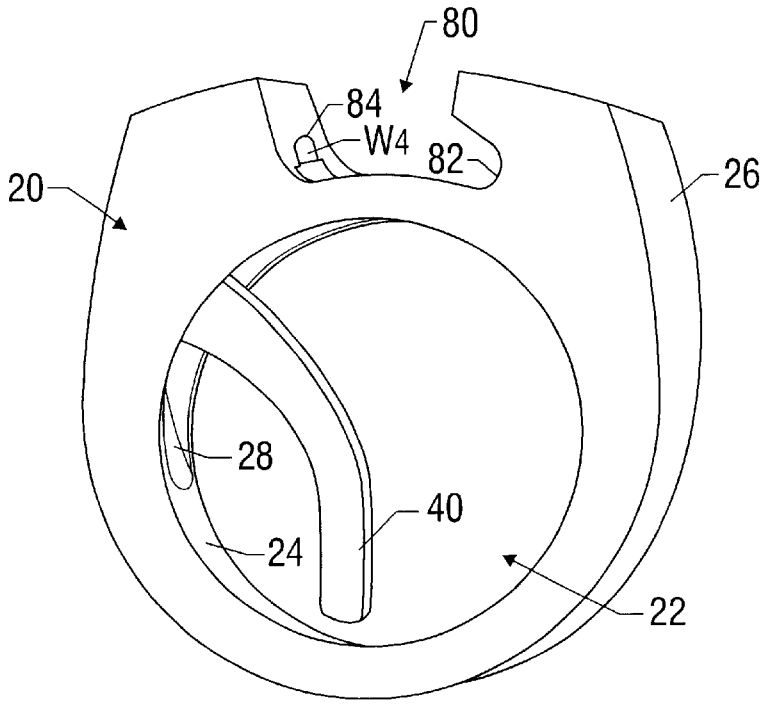
FIG. 10 illustrates the embodiment of the body of FIGS. 9A–B.
Figure 11:
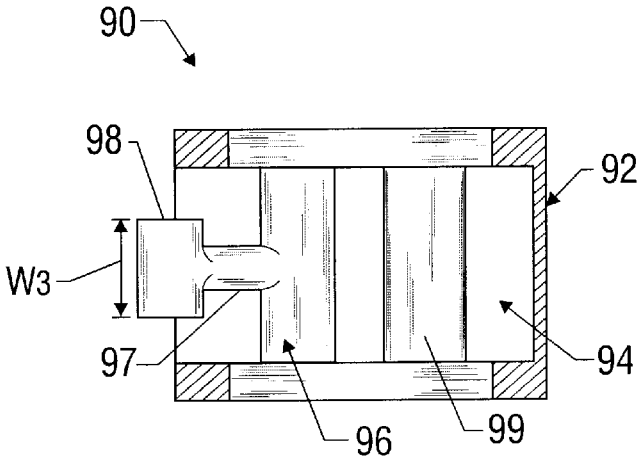
FIG. 11 illustrates a bottom view of the embodiment of the interchangeable module of FIGS. 9A–B.

Referring to FIGS. 9–11, yet another embodiment of a decorative article 14 with an interchangeable module 90 in accordance with the present invention is illustrated. In FIGS. 9A–B, the decorative article 14 with interchangeable module 90 is illustrated in a perspective view and a cross-sectional view, respectively. In FIG. 10, the embodiment of the body or shank 20 of FIGS. 9A–B is individually illustrated in a perspective view. In FIG. 11, the embodiment of the module 90 of FIGS. 9A–B is individually illustrated in a bottom view.

The decorative article 14 includes a body or shank 20. The body or shank 20 includes inner and outer surfaces 24 and 26 and defines an aperture 80 therethrough. The body 20 includes an opening 22 and a hollow or inner cavity 28 defined by the inner surface 24. A supporting member or bar 40 is pivotally connected to the inner surface 24 by a pivotal connection 46 disposed in the hollow 28. The aperture 80 is contoured to define a groove 82. Opposite the groove 82, the aperture 80 is contoured to define a catch opening 84, which opens to an adjacent niche or nook 86 defined by the inner surface 24. The niche 86 has a more expansive dimension or width than a dimension or width $W_4$ of the catch opening 84.

The interchangeable module 90 in the present embodiment is mounted from the outer surface 26 of the body 20. The outer-mounted module 90 includes a decorative portion 92, which may have a large decorative element 93. The module 90 includes a retaining portion 94 having at least one retaining member 96. The retaining member 96 includes an arm 97 pivotally attached to the decorative portion 92. For example, the retaining member 96 may be disposed in apertures 95 in the decorative portion 92. The apertures 95 are preferably not visible on the decorative element 93 of the decorating portion 92, as best shown in FIG. 9A.

A catch 98 is disposed on a distal end of the pivotable arm 97. The catch 98 has a dimension or width $W_3$ greater than the dimension or width $W_4$ of the catch opening 84. The catch 98 is a suitable element to be disposed in the niche 86 and engaged with or retained against the inner surface 24 adjacent the catch opening 84. The catch 98 may be, for example, a bulbous end, a cross member, a hook, a tooth, or a "tee" disposed on the distal end of the arm 97. In the present embodiment of the module 90, the retaining portion 94 also includes a fixed member or key 99. The fixed member 99 is fixedly attached to the decorative portion 92 and positions in the groove 82 defined by the aperture 80.

The module 90 is mounted on the body 20 from the outer surface 26 by installing the retaining portion 94 into the aperture 80. Specifically, the retaining member 96 is pivoted to extend downward from the decorative portion 92. The fixed member 99 is positioned in the groove 82, while the retaining member 96 is inserted into the aperture 80. The retaining member 96 is then pivoted so that the arm 97 is disposed through the catch opening 84. The catch 98 is positioned in the niche 86 and is engaged with or retained against the inner surface 24 adjacent the catch opening 84. The module 90 is limited to removal from the body 20 in the one direction towards the outer surface 26. The supporting member 40 is pivoted to contact the retaining portion 94 and hold the module 90 in the aperture 80. The module 90 may be selectively removed from the body 20 by reversing the above assembly.

Figure 12:
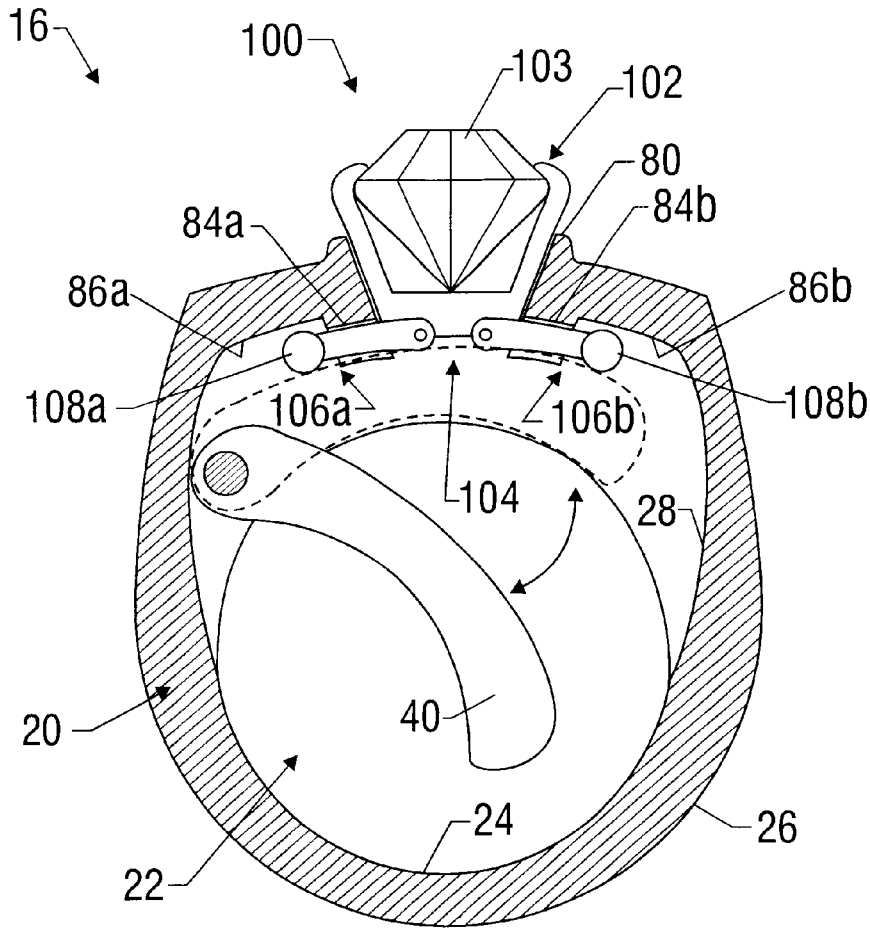
FIG. 12 illustrates yet another embodiment of a decorative article in accordance with the present invention.

Referring to FIG. 12, yet another embodiment of a decorative article 16 in accordance with the present invention is illustrated in a cross-sectional view. The decorative article 16 includes a body or shank 20 and an interchangeable module 100. In the present embodiment, the interchangeable module 100 is also an outer-mounted module. The module 100 includes a decorative portion 102 and a retaining portion 104. The decorative article 16 of the present embodiment is particularly suitable for modules 100 with a large decorative element 103, such as a diamond or a large bezel. The retaining portion 104 includes first and second retaining members 106*a* and 106*b* pivotally attached to the decorative portion 102. Each retaining member 106*a* and 106*b* includes a catch 108*a* and 108*b*.

The module 100 is mounted from the outer surface 26 of the body 20 by installing the retaining members 106*a* and 106*b* through an aperture 80 defined in the body 20. The retaining portion 104 is installed in the aperture 80 so that the decorative element 103 is exposed outside the body 20. The retaining members 106*a* and 106*b* are then pivoted through catch openings 82*a* and 82*b* defined by the aperture 80. The catches 108*a* and 108*b* are then disposed in complementary recesses 86*a* and 86*b* defined by the inner surface 24.

The catches 108*a* and 108*b* engage with or retain against the inner surface 24 adjacent the catch openings 82*a* and 82*b*. The catches 108*a* and 108*b* prevent the module 100 from being removed from the aperture 80 in a direction towards the outer surface 26. The supporting member or bar 40 is then pivoted to contact the first and second retaining members 106*a* and 106*b*. The supporting member 40 sustains the catches 108*a* and 108*b* adjacent the inner surface 24 to hold the module 100 mounted on the body 20. The module 100 may be selectively removed from the body 20 by reversing the above assembly.

Figure 13:
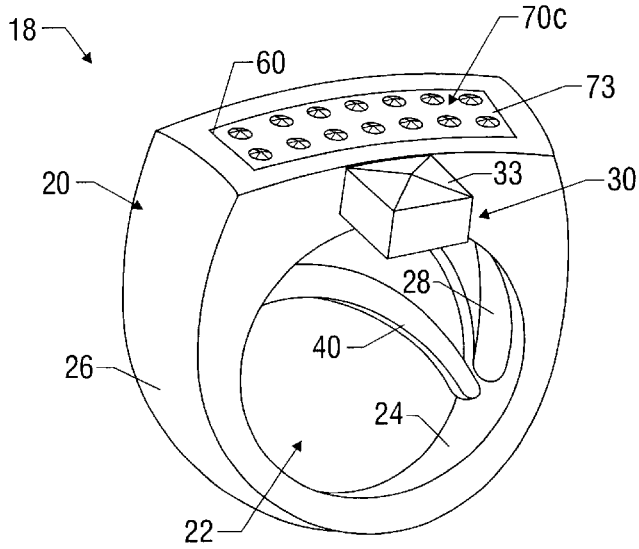
FIGS. 13–16 illustrate embodiments of decorative articles having combinations of interchangeable modules in accordance with the present invention.

Referring to FIG. 13, an embodiment of a decorative article 18 is illustrated having a combination of interchangeable modules 30 and 70*c* in accordance with the present invention. The decorative article 18 includes a side-mounted, interchangeable module 30, such as discussed above with reference to FIGS. 1–5. The decorative article 18 also includes an inner-mounted, interchangeable module 70*c*, such as discussed above with reference to FIGS. 6–8.

Figure 14A:
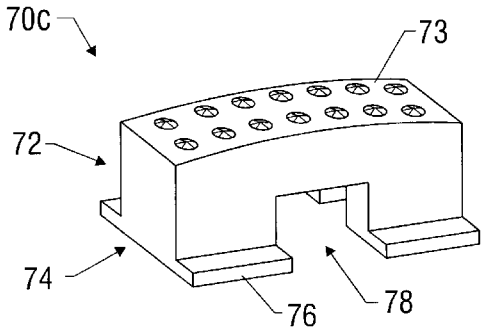

According to one embodiment illustrated in FIG. 14A, the inner-mounted module 70*c* may include a gap 78 defined in the retaining portion 74 to accommodate the retaining portion (34) of the side-mounted module 30 as described below. To mount the modules 30 and 70*c* on the body 20, the inner-mounted module 70*c* is first mounted on the body 20. The module 70*c* is positioned into the mounting hole 60 from the inner surface 24 as discussed above. The decorative element 73 is positioned adjacent the outer surface 26. Next, the retaining portion (34) of the side-mounted module 30 is installed in the slot (50) in the body 20 as discussed above. The retaining portion (34) is disposed in the gap 78 defined in the inner-mounted module 70*c*. The supporting member 40 is pivoted to contact both retaining portions (34) and 74 to sustain the side and inner-mounted modules 30 and 70*c* mounted to the body 20.

Figure 14B:
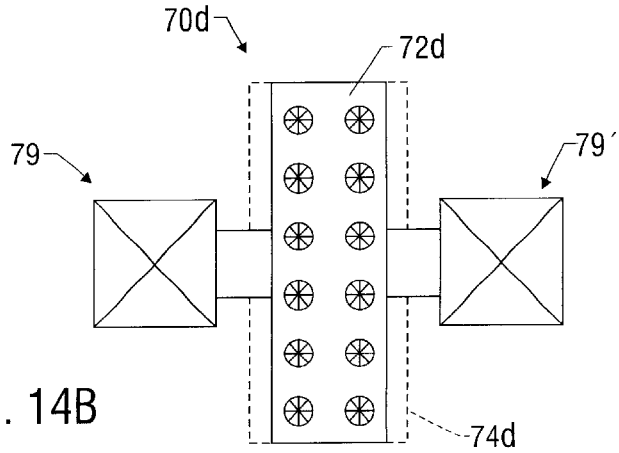

According to another embodiment illustrated in FIG. 14B, an inner-mounted module 70*d* for use with the decorative article 18 of FIG. 13 may include one or more integrally attached, side modules 79 and 79'. The module 70*d* includes a decorative portion 72*d* to be positioned in the mounting hole 60 as described above. The module 70*d* may include a retaining portion 74*d*; however, this is not strictly necessary. The one or more integrally attached, side modules 79 and 79' are installed in slots (50) in the body 20 as discussed above.

Figure 15:
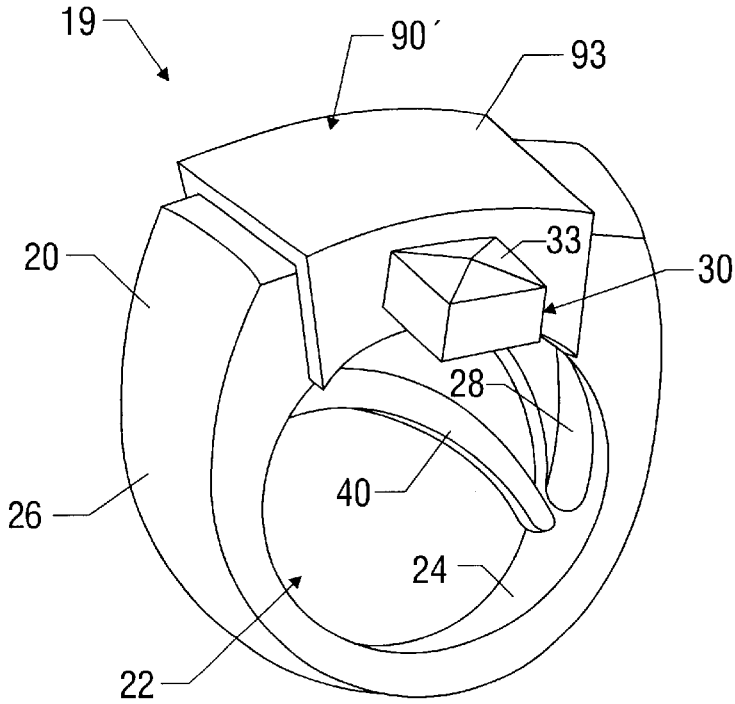

Referring to FIG. 15, another embodiment of a decorative article 19 is illustrated having a combination of interchangeable modules 30 and 90' in accordance with the present invention. The decorative article 19 in FIG. 15 includes a side-mounted, interchangeable module 30, such as discussed above with reference to FIGS. 1–5. The decorative article 19 also includes an outer-mounted, interchangeable module 90*a*, such as discussed above with reference to FIGS. 9–11.

Figure 16:
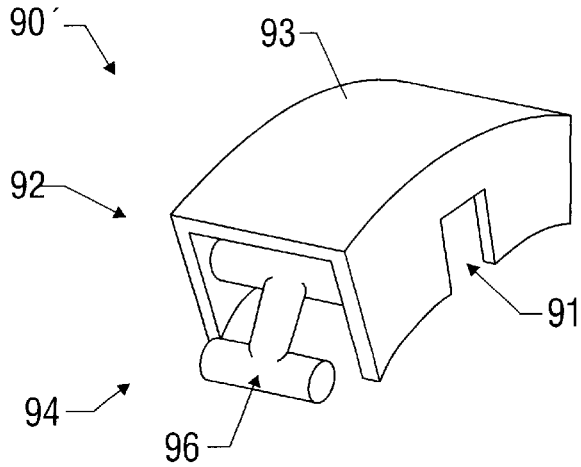

According to one embodiment illustrated in FIG. 16, the outer-mounted module 90*a* may include a slot 91 to accommodate the retaining portion (34) of the side-mounted module 30. To mount the modules 30 and 90*a* on the body 20, the outer-mounted module 90*a* is mounted in a mounting aperture (80) as discussed above. The slot 91 of the outer-mounted module 90*a* is positioned adjacent a slot (50) defined in the body 20. The adjacent slots (50) and 91 accommodate the retaining portion (34) of the side-mounted module 30. Finally, the supporting member 40 is pivoted to contact the retaining portions (34) and 94 of both the modules 30 and 90*a*.

The embodiments depicted in FIGS. 13–16 illustrate only a few of several, other possible combinations of interchangeable modules that may be mounted together on the body or shank 20. With the benefit of the present disclosure, one of ordinary skill in the art will recognize that the present invention is applicable to a number of additional embodiments combining two or more interchangeable modules on the body or shank 20.

Figure 17A:
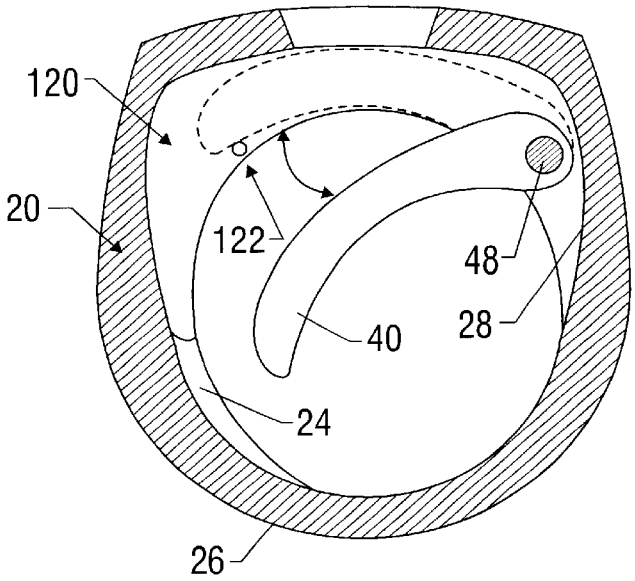
FIGS. 17A–D illustrate embodiments of locking mechanisms for decorative articles in accordance with the present invention.

As noted above, the present invention operates sufficiently without the use of a locking mechanism: however; in some circumstances a locking mechanism may be desirable. For example, a locking mechanism may be beneficial, but not necessarily essential, for use with an interchangeable module having a heavy or expensive decorative element or stone. Referring to FIG. 17A, an embodiment of a locking mechanism 120 is illustrated in accordance with the present invention. The locking mechanism 120 is a snap lock, including one or more protrusions 122 on the inner surface 24 of the body 20. When the supporting member 40 is pivoted to the supporting position shown by dashed lines, the protrusions 122 of the snap lock 120 hold the supporting member 40 with a compression fit. It is understood, of course, that the protrusions 122 may be disposed on the supporting member 40. With use of the snap lock 120, a slit or thin lip (not shown) may be necessary on the distal end of the supporting member 40 to facilitate the easily release of the supporting member 40 from the snap lock 120.

Figure 17B:
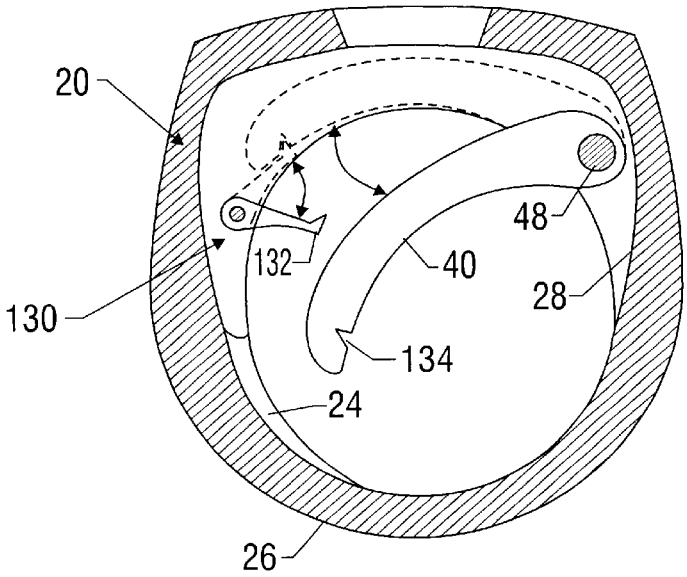

Referring to FIG. 17B, another embodiment of a locking mechanism 130 is illustrated in accordance with the present invention. The locking mechanism 130 is a reverse hinge having a catch or tooth 132 to engage with or retain against a complimentary recess 134 defined in the end of the supporting member 40. Once the supporting member 40 is disposed in the hollow 28 of the body 20, the reverse hinge 130 may be pivoted to dispose the tooth 132 in the recess 134. In this way, the supporting member 40, being caught by the tooth 132, is unable to move away from the inner surface 24. To release the supporting member 40, the reverse hinge 130 may be pivoted to remove the tooth 132 from the recess 134 and allow the supporting member 40 to pivot away from the inner surface 24.

Figure 17C:
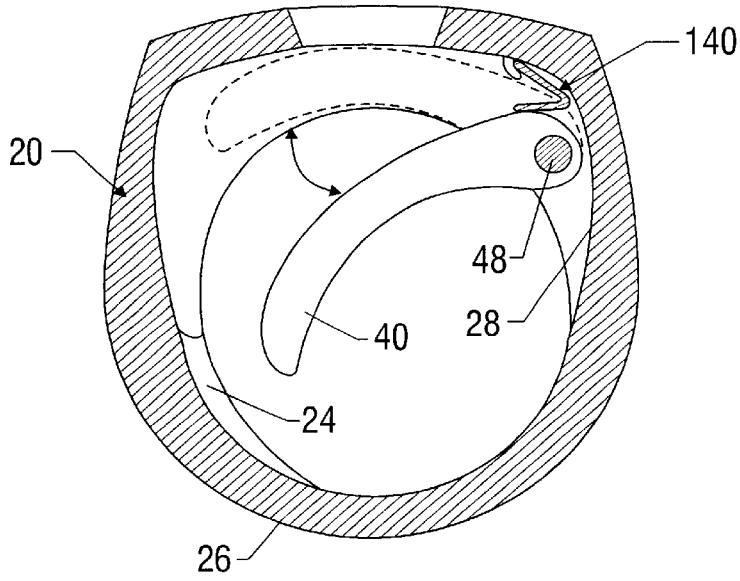

In another embodiment of a locking mechanism, a biasing member 140, such as a leaf spring shown here in FIG. 17C, may be used individually or in combination with the other locking mechanisms to bias the supporting member 40. The biasing member 130 may be configured to sustain the supporting member 40 in the hollow 28 and maintain the module (not shown) mounted on the body 20. Again, the present invention operates without the use of such a biasing member 140; however, in some circumstances the biasing member 140 may be desirable. Furthermore, depending on the desired biased position of the supporting member 40, the biasing member 140 may be configured to position the supporting member 40 in the opening 22 of the body 20. The body 20 may then be immediately ready to remove or receive an interchangeable module without requiring the wearer to release the supporting member 40 from the supporting position.

Figure 17D:
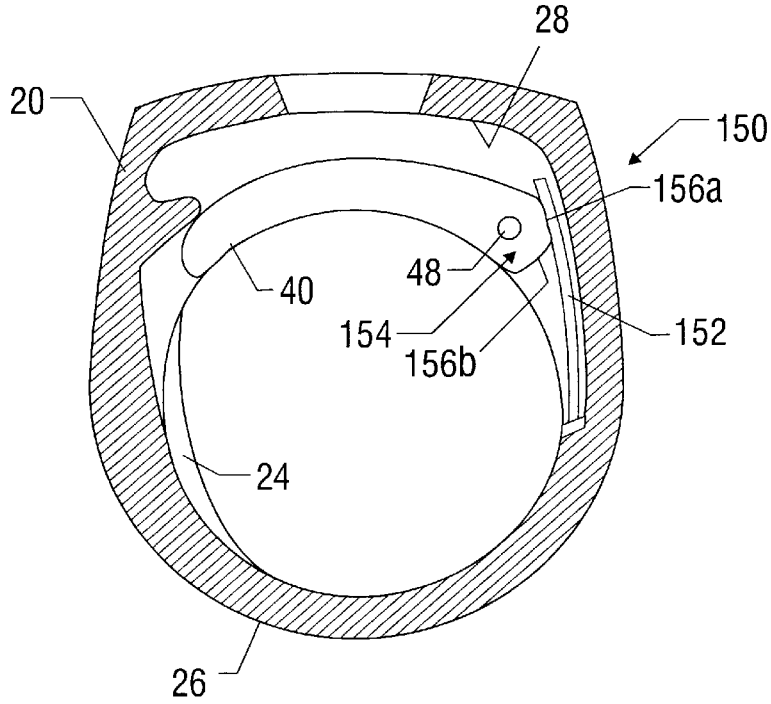

In yet another embodiment of a locking mechanism 150 in FIG. 17D, a cam action spring 152 may be used in conjunction with a cam 154 on the end of the supporting member 40. The cam action spring 152 acts against the cam 154, which is configured to position the supporting member 40. For example, the cam 154 may have two surfaces 156*a* and 156*b* forming a wedge on the end of the supporting member 40. The first surface 156*a* may be flat, while the second surface 156*b* may be slightly rounded. When the first surface 156*a* is engaged with the cam action spring 152, the supporting member 40 is positioned adjacent the inner surface 26 as shown in FIG. 17D to sustain an interchangeable module (not shown) mounted on the body 20. The supporting member 40 may be selectively moved away from the inner surface 26 by overcoming the biasing of the cam action spring 152 against the cam 154.

Locking mechanisms, such as the snap lock 120, reverse hinge 130, leaf spring 140 and cam with cam action spring 150 discussed herein, are known in the art of jewelry design. Other suitable locking mechanisms are applicable to the present invention, the implementation of which would be readily recognized by one of ordinary skill in the art with the benefit of the present disclosure.

The embodiments of the decorative articles illustrated herein, including embodiments of the body, supporting member, and interchangeable modules, have been depicted in a basic form in order to illustrate the gross anatomy of the present invention more clearly. It is understood that these basic forms may be aesthetically designed or altered by one of ordinary skill in the art without departing from the present invention.

With the benefit of the present disclosure, one of ordinary skill in the art of jewelry design will recognize that the present invention is applicable to decorative articles other than the embodiments of rings explicitly illustrated herein. For example, the present invention is applicable to other embodiments of decorative articles, including but not limited to bracelets, chokers, necklaces, earrings, or pendants. In these additional embodiments of decorative articles, the construction of the interchangeable modules and supporting member may be substantially the same. The body or shank, however, is defined as a piece of material for supporting and displaying the interchangeable module. The body or shank has at least two surfaces with an aperture defined therethrough. As such, the body or shank need not be limited to the ring shape as explicitly embodied herein.

For example, an additional embodiment of a decorative article in accordance with the present invention may include a bracelet with interchangeable modules, wherein the body is a large, thin member worn on the wrist. In another additional embodiment, a decorative article in accordance with the present invention may include a choker with interchangeable modules, wherein the body is a member worn on the neck. In yet another additional embodiment, a decorative article in accordance with the present invention may include a pendant with interchangeable modules, wherein the body is a piece of material to be hung from a necklace. These additional embodiments of the bracelet, choker, and pendant may preferably include a locking mechanism, such as a cam action spring acting against a cam for biasing the supporting arm to help sustain the modules as described above.

With the benefit of the present disclosure, one of ordinary skill in the art of jewelry design will further recognize that the interchangeable modules of the present invention may include embodiments other than those explicitly illustrated herein. Accordingly, an interchangeable module according to the present invention may include a decorative portion, item or element encompassing, but not limited to, entire classes of housings, settings, mountings, bezels, ornaments, jewels, stones, ancillary shanks, guards, bands, chains, filigrees, finials, and decorative knobs.

While the invention has been described with reference to the preferred embodiments, obvious modifications and alterations are possible by those skilled in the related art. Therefore, it is intended that the invention include all such modifications and alterations to the full extent that they come within the scope of the following claims or the equivalents thereof.

What is claimed is:

1. A decorative article comprising:

a body having first and second surfaces and defining an aperture therethrough;

an interchangeable module comprising an arm pivotally connected to the module and at least partially disposed in the aperture; and a supporting member pivotally attached to the first surface and pivotable to contact at least a portion of the arm and maintain the module mounted on the body.

2. The decorative article of claim 1, wherein the arm comprises a first dimension engaging a second dimension defined by the aperture, the first dimension being larger than the second dimension.

3. The decorative article of claim 1, wherein the arm comprises a positive stopping surface engaging a shoulder defined by the aperture.

4. The decorative article of claim 1, wherein the aperture defines a catch opening and wherein the arm comprises:

a catch disposed on a distal end of the arm and engaging the first surface adjacent the catch opening.

5. The decorative article of claim 4, wherein the catch is selected from the group consisting of a shoulder, a positive stopping surface, a bulbous end, a cross member, a hook, a tooth, and a tee.

6. The decorative article of claim 1, further comprising a second module interchangeably mounted in a second aperture defined in the interchangeable module.

7. The decorative article of claim 1, further comprising a locking mechanism for sustaining the supporting member when pivoted to contact the arm.

8. The decorative article of claim 1, wherein the decorative article is a ring with the body having a finger opening defined by the first surface.

9. The decorative article of claim 8, wherein the first surface defines a cavity substantially receiving the supporting member when pivoted to contact the arm.

10. The decorative article of claim 9, wherein the supporting member has a surface completing the opening of the ring when contacting the arm.

11. The decorative article of claim 1, wherein the arm comprises an elongate limb having one end pivotally connected to the module by a hinge.

12. A decorative article comprising:

a body having first and second surfaces which form an edge, the body defining a slot such that the slot is open from the first surface to the second surface and has an open side along the edge;

an interchangeable module, comprising:

a decorative portion having a side, the side disposed adjacent the second surface when mounted on the body, a narrow member connected to the side of the decorative portion and having an end, the narrow member inserted into the slot from the open side along the edge when mounted on the body, whereby the decorative portion is positioned adjacent the second surface of the body without inserting the decorative portion through the slot, and a retaining member connected to the end of the narrow member and engaging the first surface adjacent the slot; and a supporting member pivotally attached to the first surface of the body and pivotable to contact the retaining member and maintain the module mounted on the body.

13. The decorative article of claim 12, wherein the interchangeable module further comprises a second decorative portion connected to the retaining member by a second narrow member, the second narrow member inserted into a second open side of a second slot defined in the body.

14. The decorative article of claim 12, wherein the retaining member comprises a first dimension larger than a second dimension defined by the slot.

15. The decorative article of claim 14, wherein the retaining member and the narrow member form a tee.

16. The decorative article of claim 12, wherein the retaining member is selected from the group consisting of a shoulder, a positive stopping surface, a bulbous end, a cross member, a hook, a tooth, and a tee.

17. A decorative article comprising:

a body having first and second surfaces and defining an aperture therethrough;

an interchangeable module comprising:

a decorative portion disposed adjacent the second surface, at least one retaining member comprising:

an arm pivotally attached to the decorative portion and disposed through a catch opening defined by the aperture, and a catch disposed on a distal end of the arm and engaging the first surface adjacent the catch opening; and a supporting member pivotally attached to the first surface of the body and pivotable to contact the at least one retaining member and maintain the module mounted on the body.

18. The decorative article of claim 17, wherein the catch comprises a first dimension larger than a second dimension defined by the catch opening.

19. The decorative article of claim 17, wherein the module comprises a fixed member attached to the decorative portion and disposed in a groove defined by the aperture.

20. The decorative article of claim 17, wherein the module comprises:

a second arm pivotally attached to the decorative portion and disposed through a second catch opening defined by the aperture; and a second catch disposed on a distal end of the second arm and engaging the first surface adjacent the second catch opening.

21. A method for mounting an interchangeable module on a ring, the ring having inner and outer surfaces and defining an aperture therethrough, the method comprising the steps of:

disposing a first pivotable member of the module at feast partially through the aperture;

pivoting the first pivotable member against the inner surface adjacent the aperture;

pivoting a second pivotable member attached to the inner surface;

contacting the first pivotable member with the second pivotable member; and maintaining the first pivotable member against the inner surface with the second pivotable member.

22. The method of claim 21, wherein contacting the first pivotable member with the second pivotable member comprises the step of hiding the second pivotable member with the inner surface when contacting the first pivotable member.

23. The method of claim 21, wherein pivoting the first pivotable member against the inner surface adjacent the aperture comprises the steps of:

positioning a narrow dimension of the first pivotable member through a smaller dimension defined by the aperture, and engaging a larger dimension of the first pivotable member on the smaller dimension defined by the aperture.

24. The method of claim 21, wherein pivoting the first pivotable member against the inner surface adjacent the aperture comprises the step of stopping a surface of the first pivotable member against a shoulder defined by the aperture.

25. The method of claim 24, wherein pivoting the first pivotable member against the inner surface adjacent the aperture comprises the steps of:

pivoting an arm through a smaller dimension defined by the aperture, and engaging a catch on a distal end of the arm on the smaller dimension defined by the aperture.

26. A modular article of jewelry, comprising:

a main body having inner and outer surfaces which form an edge, the main body defining a first slot such that the first slot is open from the outer surface to the inner surface and has a first open side along the edge;

a first interchangeable module mounting on the main body and comprising:

a first decorative body, and a first arm having a first end, an intermediate portion, and a second end, the first end connected to the first decorative body, the intermediate portion of the first arm inserting into the first slot from the first open side along the edge when mounting the first module on the main body, whereby the first decorative body is positioned adjacent the outer surface of the main body without inserting the first decorative body through the first slot; and a bar for maintaining the first module mounted on the main body, the bar pivotally attached to the inner surface of the main body and pivotable to contact a portion of the first module.

27. The modular article of jewelry of claim 26, wherein the second end of the first arm further comprises a catch engaging the inner surface adjacent the first slot, the catch selected from the group consisting of a shoulder, a positive stopping surface, a bulbous end, a cross member, a hook, a tooth, and a tee.

28. The modular article of jewelry of claim 26, wherein the first decorative body has a side connected to the first end of the first arm, the side of the first decorative body positioning adjacent the outer surface of the body such that the first decorative body is mounted outside the main body.

29. The modular article of jewelry of claim 26, wherein:

the main body defines a second slot through the inner and outer surfaces, the second slot having a second open side, and the first interchangeable module further comprises a second decorative body having a second side connected to the second end of the first arm, the intermediate portion of the first arm inserting into the second slot from the second open side, the second side of the second decorative body positioning adjacent the outer surface of the main body.

30. The modular article of jewelry of claim 26, wherein:

the main body defines a second slot through the inner and outer surfaces, the second slot having a second open side, and the modular article of jewelry further comprises a second interchangeable module mounting on the main body, the second interchangeable module comprising:

a second decorative body positioning adjacent the outer surface of the main body, and a second arm connected to the second decorative body, an intermediate portion of the second arm inserting into the second slot from the second open side when mounting the second module on the main body.

31. The modular article of jewelry of claim 26, wherein:

the main body defines a closed mounting hole through the inner and outer surfaces, and the first decorative body inserts into the closed mounting hole such that the first decorative body is at least partially exposed from the outer surface of the main body.

32. The modular article of jewelry of claim 26, wherein:

the main body defines a closed mounting hole through the inner and outer surfaces, and the first module further comprises a second decorative body connected to the second end of the first arm, the second decorative body inserting into the closed mounting bole such that the first decorative body is mounted outside the main body and such that the second decorative body is at least partially exposed from the outer surface of the main body.

33. The modular article of jewelry of claim 26, wherein:

the main body defines a closed mourning hole through the inner and outer surfaces, and the modular article of jewelry further comprises a second interchangeable module inserting into the closed mounting hole such that the second module is at least partially exposed from the outer surface of the main body, wherein a portion of the first arm of the first module contacts the second module.

34. A modular article of jewelry, comprising:

a main body having inner and outer surfaces and defining a first slot through the inner and outer surfaces, the first slot having a first open side, the main body defining a closed mounting hole through the inner and outer surface;

a first interchangeable module mounting on the main body and comprising:

a first decorative body, and a first arm having a first end, an intermediate portion, and a second end, the first end connected to the first decorative body, the intermediate portion of the first arm inserting into the first slot from the first open side when mounting the first module on the main body;

a second interchangeable module having a pivotable arm connected to the second module and disposed through the closed mounting hole, wherein a portion of the first arm of the first module contacts the pivotable arm of the second module; and a bar for maintaining the first and second modules mounted on the main body, the bar pivotally attached to the inner surface of the main body and pivotable to contact a portion of the first module.

* * * * *

UNITED STATES PATENT AND TRADEMARK OFFICE

CERTIFICATE OF CORRECTION

PATENT NO. : 6,701,747 B2
DATED : March 9, 2004
INVENTOR(S) : Hartgrove

It is certified that error appears in the above-identified patent and that said Letters Patent is hereby corrected as shown below:

Column 15,
Line 9, please replace “mourning” with -- mounting --.

Signed and Sealed this

Twenty-second Day of June, 2004

JON W. DUDAS
*Acting Director of the United States Patent and Trademark Office*